US008454770B1

(12) United States Patent
Erickson et al.

(10) Patent No.: US 8,454,770 B1
(45) **Date of Patent: *Jun. 4, 2013**

(54) NON-TOXIC PERCUSSION PRIMERS AND METHODS OF PREPARING THE SAME

(75) Inventors: Jack Erickson, Andover, MN (US); Joel L. Sandstrom, Corcoran, MN (US); Gene Johnston, Radford, VA (US); Neal Norris, Lewiston, ID (US); Patrick Braun, Clarkston, WA (US); Reed Blau, Richmond, UT (US); Lisa Spendlove Liu, Layton, UT (US)

(73) Assignee: Alliant Techsystems Inc., Minneapolis, MN (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/473,324

(22) Filed: May 16, 2012

Related U.S. Application Data

(63) Continuation of application No. 11/704,530, filed on Feb. 9, 2007, now Pat. No. 8,202,377.

(51) Int. Cl.

| | |
|---|---|
| ***C06B 33/00*** | (2006.01) |
| ***C06B 33/08*** | (2006.01) |
| ***D03D 23/00*** | (2006.01) |
| ***D03D 43/00*** | (2006.01) |

(52) U.S. Cl.
USPC ..... 149/109.4; 149/37; 149/38; 149/108.6; 149/109.2

(58) Field of Classification Search
USPC ..... 149/42, 37, 38, 108.6, 109.2, 109.4
See application file for complete search history.

(56) References Cited

U.S. PATENT DOCUMENTS

| | | | | |
|---|---|---|---|---|
| 998,007 | A | | 7/1911 | Imperiali |
| 2,194,480 | A | | 3/1940 | Pritham et al. |
| 2,231,946 | A | | 2/1941 | Rechel et al. |
| 2,349,048 | A | * | 5/1944 | Mackey et al. ..... 149/11 |
| 2,649,047 | A | | 8/1953 | Silverstein |
| 2,929,699 | A | | 3/1960 | Audrieth et al. |
| 2,970,900 | A | | 2/1961 | Woodring et al. |
| 3,026,221 | A | | 3/1962 | Krist |
| 3,113,059 | A | | 12/1963 | Ursenbach |
| 3,181,463 | A | | 5/1965 | Morgan et al. |
| 3,275,484 | A | | 9/1966 | Foote et al. |
| 3,367,805 | A | | 2/1968 | Clay et al. |
| 3,420,137 | A | | 1/1969 | Staba |
| 3,437,534 | A | | 4/1969 | McEwan et al. |
| 3,488,711 | A | | 1/1970 | Dany et al. |

(Continued)

FOREIGN PATENT DOCUMENTS

| | | |
|---|---|---|
| DE | 2513735 | 10/1975 |
| DE | 19606237 | 8/1996 |

(Continued)

OTHER PUBLICATIONS

Application and File History for U.S. Appl. No. 13/456,920, filed Apr. 26, 2012, inventors Erickson et al.

(Continued)

*Primary Examiner* — James McDonough
(74) *Attorney, Agent, or Firm* — Christensen Fonder P.A.

(57) ABSTRACT

A percussion primer composition including at least one explosive, at least one nano-coated fuel particle having natural surface oxides thereon, at least one oxidizer, optionally at least one sensitizer, optionally at least one buffer, and to methods of preparing the same.

35 Claims, 5 Drawing Sheets

U.S. PATENT DOCUMENTS

| | | | | |
|---|---|---|---|---|
| 3,634,153 | A | 1/1972 | Perkins et al. | |
| 3,650,856 | A | 3/1972 | Artz | |
| 3,707,411 | A | 12/1972 | Gawlick et al. | |
| 3,726,217 | A | 4/1973 | Dedman et al. | |
| 3,755,019 | A | 8/1973 | Huskins et al. | |
| 3,767,488 | A | 10/1973 | Seals | |
| 3,904,451 | A | 9/1975 | Rainone | |
| 4,014,719 | A | 3/1977 | Wells | |
| 4,133,707 | A | 1/1979 | Andrew | |
| 4,142,927 | A | 3/1979 | Walker et al. | |
| 4,145,969 | A | 3/1979 | Gawlick et al. | |
| 4,196,026 | A | 4/1980 | Walker et al. | |
| 4,304,614 | A | 12/1981 | Walker et al. | |
| 4,315,897 | A | 2/1982 | Staendeke et al. | |
| 4,336,085 | A | 6/1982 | Walker et al. | |
| 4,428,292 | A | 1/1984 | Riggs | |
| 4,522,665 | A | 6/1985 | Yates, Jr. et al. | |
| 4,554,031 | A | 11/1985 | Kerviel et al. | |
| 4,581,082 | A | 4/1986 | Hagel et al. | |
| 4,698,215 | A | 10/1987 | Albanesi et al. | |
| 4,728,375 | A | 3/1988 | Simpson | |
| 4,853,288 | A | 8/1989 | Staendeke et al. | |
| 4,963,201 | A | 10/1990 | Bjerke et al. | |
| 4,976,793 | A | 12/1990 | Zimmerman | |
| 5,027,707 | A | 7/1991 | Mei | |
| 5,167,736 | A | 12/1992 | Mei et al. | |
| 5,216,199 | A | 6/1993 | Bjerke et al. | |
| 5,316,600 | A | 5/1994 | Chan et al. | |
| 5,388,519 | A | 2/1995 | Guindon et al. | |
| 5,417,160 | A | 5/1995 | Mei et al. | |
| 5,449,423 | A | 9/1995 | Cioffe | |
| 5,466,315 | A | 11/1995 | Erickson et al. | |
| 5,522,320 | A | 6/1996 | Dillehay | |
| 5,557,061 | A | 9/1996 | Ramaswamy | |
| 5,567,252 | A | 10/1996 | Mei et al. | |
| 5,610,367 | A | 3/1997 | Erickson et al. | |
| 5,672,219 | A | 9/1997 | Rinaldi et al. | |
| 5,684,268 | A | 11/1997 | Lopata | |
| 5,717,159 | A | 2/1998 | Dixon et al. | |
| 5,780,768 | A | 7/1998 | Knowlton et al. | |
| 5,831,208 | A | 11/1998 | Erickson | |
| 5,939,661 | A | 8/1999 | Bayliss | |
| 6,057,264 | A | 5/2000 | Bradbury | |
| 6,066,214 | A | 5/2000 | Comfort | |
| 6,165,294 | A | 12/2000 | Fogelzang et al. | |
| 6,322,648 | B2 | 11/2001 | Rayer et al. | |
| 6,478,903 | B1 | 11/2002 | John, Jr. et al. | |
| 6,544,363 | B1 | 4/2003 | Erickson | |
| 6,581,520 | B1 | 6/2003 | Koch et al. | |
| 6,588,344 | B2 | 7/2003 | Clark et al. | |
| 6,612,242 | B2 | 9/2003 | Raupp et al. | |
| 6,620,267 | B1 | 9/2003 | Guindon et al. | |
| 6,641,683 | B1 | 11/2003 | McKenney, Jr. et al. | |
| 6,645,625 | B2 | 11/2003 | Holrold et al. | |
| 6,663,731 | B1 | 12/2003 | Rose et al. | |
| 6,878,221 | B1 * | 4/2005 | Mei et al. | 149/41 |
| 7,129,348 | B1 | 10/2006 | Wardle et al. | |
| 7,192,649 | B1 | 3/2007 | Jouet et al. | |
| 7,670,446 | B2 | 3/2010 | Puszynski et al. | |
| 7,670,466 | B2 * | 3/2010 | Lee | 204/224 M |
| 8,192,568 | B2 | 6/2012 | Erickson et al. | |
| 8,202,377 | B2 * | 6/2012 | Erickson et al. | 149/109.6 |
| 8,206,522 | B2 | 6/2012 | Sandstrom et al. | |
| 2002/0127403 | A1 | 9/2002 | Horold et al. | |
| 2002/0129724 | A1 * | 9/2002 | Clark et al. | 102/307 |
| 2005/0183805 | A1 | 8/2005 | Pile et al. | |
| 2005/0189053 | A1 * | 9/2005 | Pile et al. | 149/108.6 |
| 2005/0224147 | A1 | 10/2005 | Jung et al. | |
| 2006/0060273 | A1 | 3/2006 | Smith | |
| 2006/0113014 | A1 * | 6/2006 | Puszynski et al. | 149/40 |
| 2006/0219341 | A1 | 10/2006 | Johnston et al. | |
| 2006/0272756 | A1 | 12/2006 | Kneisl et al. | |
| 2007/0102076 | A1 | 5/2007 | Redecker et al. | |
| 2008/0245252 | A1 * | 10/2008 | Erickson et al. | 102/204 |
| 2010/0116385 | A1 | 5/2010 | Johnston et al. | |
| 2011/0000390 | A1 | 1/2011 | Erickson et al. | |
| 2011/0239887 | A1 | 10/2011 | Sandstrom et al. | |

FOREIGN PATENT DOCUMENTS

| | | |
|---|---|---|
| EP | 0070932 | 2/1983 |
| EP | 0283759 | 9/1988 |
| EP | 0334725 | 9/1989 |
| EP | 0699646 | 3/1996 |
| EP | 0911366 | 4/1999 |
| EP | 0952130 | 10/1999 |
| EP | 1195366 | 4/2002 |
| EP | 1443034 | 8/2004 |
| EP | 0737174 | 9/2004 |
| WO | WO9515298 | 6/1995 |
| WO | WO9612770 | 5/1996 |
| WO | WO9944968 | 9/1999 |
| WO | WO0121558 | 3/2001 |
| WO | WO0206421 | 1/2002 |
| WO | WO2006009579 | 1/2006 |
| WO | WO2006083379 | 8/2006 |
| WO | WO2008/100252 | 8/2008 |
| WO | WO2009/079788 | 7/2009 |
| WO | WO2009/102338 | 8/2009 |
| WO | WO2011/123437 | 10/2011 |

OTHER PUBLICATIONS

Application and File History for U.S. Appl. No. 13/477,723, filed May 22, 2012, inventors Sandstrom.

Application and File History for U.S. Appl. No. 13/477,750, filed May 22, 2012, inventors Johnston et al.

Nordblom et al., Frankford Arsenal Report No. R-206; The Stabilization of Commerical Red Phosphorus Final Report, Research Item No. 202.14, Frankford Arsenal Library. Apr. 1943.

United States Army, Small Caliber Ammunition Test Procedures 5.56 mm Cartridges, Picatinny Arsenal, New Jersey, Nov. 1998. pages 1-191.

Eisentrager, Frank, "Key Parameters for the Stability of Red Phosphorous", 31st International Pyrotechnic Seminar Proceedings, Jul. 2004. Colorado Springs, Colorado. Copyright 2000 IPSUSA.

Ratcliff, Andrew, "Review of Six Generations of Red Phosphorous 1950-1999 and Beyond", 27th International Pyrotechnic Seminar Proceedings, Jul. 2000. Grand Junction Colorado. Copyright 2000. IPSUSA.

Horoeld et al, "Commerical Developments in Red Phosphorous Performance and Stability for Pyrotechnics", Journal of Pyrotechnics, Issue 12. Summer 2001. Copyright 2001. IPS.

Collins et al., "The Use of Red Phosphorous in Pyrotechnics-Results of an International Investigation". 31st International Pyrotechnics Seminar Proceedings. Jul. 2004. Colorado Springs, Colorado. Copyright 2002. IPSUSA.

European Search Report for European Application No. EP07004155 dated Jul. 16, 2007.

Alenfelt, "Corrosion protection of magnesium without the use of chromates", Pyrotechnica XVI (Aug. 1995), pp. 44-49. Pyrotechnia Publications, Austin, Texas.

Muller, "Citric acid as corrosion inhibitor for aluminum pigment", Corrosion Science, vol. 46, No. 1. Jan. 2004. p. 159-167.

International Search Report and Written Opinion of International Application No. PCT/US2008/068275 date of mailing Jan. 13, 2009.

International Search Report and Written Opinion of International Application No. PCT/US2007/003806 date of mailing Jan. 13, 2009.

European Office Action of European Application No. 07870653.8 dated Feb. 21, 2011.

Canadian Office Action of Canadian Application No. 2668123 dated Aug. 15, 2011.

Busky, et al., "Non-Toxic Heavy Metal Free Primers for Small Arms Cartridges—Red Phosphorous Base", presented May 8, 2007.

Definition of "composition", Hackh's Chemical Dictionary, 4th Edition. Copyright 1969 by Mc-Graw Hill, Inc. New York, NY.

Definition of "mixture", The American Heritage College Dictionary, 3rd Edition. Copyright 2000 by Houghton Mifflin.

Horold, Sebastian, "Improvements in Stability of Red Phosphorous", 27th International Pyrotechnic Seminar Proceedings, Jul. 2000, Grand Junction Colorado, Copyright 2000 IPSUSA.

Levitas, Valery I, et al., "Mechanochemical mechanism for fast reaction of metastable intermolecular composites based on dispersion of liquid metal", J. Appl. Phys. vol. 101, pp. 083524-1 through 083524-20, 2007.
Railsback, Bruce, "An Earth scientist's periodic table of the elements and their ions, "Geology, pp. 737-740, Sep. 2003.
Railsback, Bruce, "An earth scientist's periodic table of the elements and their ions, "Version 4.8, University of Georgia, Athens, Georgia, Copyright 2007. http://www.gly.uga.edu/railsback/PT.html.
Rovner, Sophie, "How a Lubricant Additive Works", chemical & Engineering News, vol. 83, No. 11, p. 10 Copyright 2005.
Ostrowski et al., "AL/MoO3 Primer Evaluation Tests Part II: Delay Cartridges, "American Institute of Aeronautics and Astronautics, AIAA/ASME/SAE/ASEE Joint Propulsion Conference, Huntsville, AL 2000. Paper 2000-3647.
Ostrowski et al., "Recent Accomplishments in MIC Primer Development at NSWC/Indian Head," Paper 2005-3514, AIAA 41st Joint Propulsion Conference, Tucson, AZ 2005.
Ostrowski et al., "Nano Energetics for US Navy Percussion Primer Applications", Energetic Materials Technology. pp. 1-6. 2006.
Stevenson et al., Frankford Arsenal Report No. R-265; Caliber .30 Red Phosphorus Primers, Third Report Research Item No. 204.0, Frankfort Arsenal Library, Feb. 1943.
Application and File History for U.S. Appl. No. 12/751,607, filed Mar. 31, 2010, inventor Sandstrom et al.
Application and File History for U.S. Appl. No. 12/029,084, filed Feb. 11, 2008, inventor Erickson.
Application and File History for U.S. Appl. No. 11/704,530, filed Feb. 9, 2007, inventor Erickson.
Application and File History for U.S. Appl. No. 12/559,218, filed Sep. 14, 2009, inventor Johnston.
Application and File History for U.S. Appl. No. 11/093,633, filed Mar. 30, 2005, inventor Johnston.

* cited by examiner

ALEX ALUMINUM IN DISTILLED WATER

SIMULATED BULK AUTOIGNITION TEMPERATURE (SBAT)

ALEX ALUMINUM IN WATER WITH BUTTER:
(3.84 g CITRIC ACID AND 1.20 g NaOH IN 100 g WATER); pH=4.29

SIMULATED BULK AUTOIGNITION TEMPERATURE (SBAT)

ALEX ALUMINUM IN WATER WITH BUTTER:
(2.40 g NaH2PO4 AND 2.84 g NaHPO4 IN 100 g WATER); pH=6.57

SIMULATED BULK AUTOIGNITION TEMPERATURE (SBAT)

NON-TOXIC PERCUSSION PRIMERS AND METHODS OF PREPARING THE SAME

This application is a continuation of application Ser. No. 11/704,530 filed Feb. 9, 2007, now U.S. Pat. No. 8,202,377, which is hereby fully incorporated herein by reference.

FIELD OF THE INVENTION

The present invention relates to percussion primer compositions for explosive systems, and to methods of making the same.

BACKGROUND OF THE INVENTION

Due to the concern over the known toxicity of certain metal compounds such as lead, there has been an effort to replace percussion primers based on lead styphnate, with lead-free percussion primers.

The Department of Defense (DOD) and the Department of Energy (DOE) have made a significant effort to find replacements for metal based percussion primers. Furthermore, firing ranges and other locales of firearms usage have severely limited the use of percussion primers containing toxic metal compounds due to the potential health risks associated with the use of lead, barium and antimony.

Ignition devices rely on the sensitivity of the primary explosive that significantly limits available primary explosives. The most common lead styphnate alternative, diazodinitrophenol (DDNP or dinol), has been used for several decades relegated to training ammunition. DDNP-based primers suffer from poor reliability that may be attributed to low friction sensitivity, low flame temperature, and are hygroscopic.

Metastable interstitial composites (MIC) (also known as metastable nanoenergetic composites (MNC) or superthermites), including $Al/MoO_3$, $Al/WO_3$, Al/CuO and $Al/Bi_22O_3$, have been identified as potential substitutes for currently used lead styphnate. These materials have shown excellent performance characteristics, such as impact sensitivity and high temperature output. However, it has been found that these systems, despite their excellent performance characteristics, are difficult to process safely. The main difficulty is handling of dry nano-size powder mixtures due to their sensitivity to friction and electrostatic discharge (ESD). See U.S. Pat. No. 5,717,159 and U.S. Patent Publication No. 200610113014.

Health concerns may be further compounded by the use of barium and lead containing oxidizers. See, for example, U.S. Patent Publication No. 20050183805.

There remains a need in the art for an ignition formulation that is free of toxic metals, is non-corrosive, may be processed and handled safely, has sufficient sensitivity, and is more stable over a broad range of storage conditions.

SUMMARY OF THE INVENTION

In one aspect, the present invention relates to a method of making a percussion primer or igniter, the method including providing at least one water wet explosive, combining at least one nano-size non-coated fuel particle having natural surface oxides thereon with at least one water wet explosive to form a first mixture and combining at least one oxidizer.

In another aspect, the present invention relates to a method for preparing a percussion primer, the method including providing at least one water wet explosive, combining at least one sensitizer with the at least one water wet explosive, combining at least one nano-size non-coated fuel particle having natural surface oxides thereon with the at least one additional water wet explosive to form a wet mixture, dry blending at least one oxidizer and at least one binder to form a resultant dry blend and adding the dry blend to the water wet mixture and mixing until homogeneous to form a final mixture.

In another aspect, the present invention relates to a percussion primer composition, the composition including at least one explosive, at least one nano-size non-coated fuel particle having natural surface oxides thereon and at least one oxidizer.

In another aspect, the present invention relates to a percussion primer premixture, the premixture including at least one explosive, at least one nano-size non-coated fuel particle having surface oxides thereon and water in an amount of about 10 wt-% to about 40 wt-% of the premixture.

In another aspect, the present invention relates to a primer composition including at least one explosive, at least one non-coated nano-size fuel particle having natural surface oxides thereon, a buffer system including at least one salt of citric acid and at least one salt of phosphoric acid and an oxidizer.

In another aspect, the present invention relates to a gun cartridge including a casing, a secondary explosive disposed within the casing and a primary explosive disposed within the casing, the primary explosive including at least one primary energetic, at least one nano-size non-coated fuel particle having natural surface oxides thereon and at least one oxidizer.

In another aspect, the present invention relates to a primer-containing ordinance assembly including a housing, a secondary explosive disposed within the housing and a primary explosive disposed within the housing, the primary explosive including at least one primary energetic, at least one nano-size non-coated fuel particle having natural surface oxides thereon; and at least one oxidizer.

These and other aspects of the invention are described in the following detailed description of the invention or in the claims.

DETAILED DESCRIPTION OF THE DRAWINGS

Figure 1A:
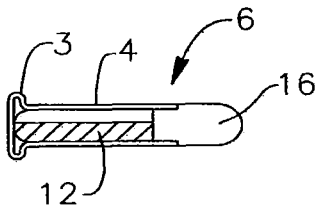
FIG. 1A is a longitudinal cross-section of a rimfire gun cartridge employing a percussion primer composition of one embodiment of the invention.

While this invention may be embodied in many different forms, there are described in detail herein specific preferred embodiments of the invention. This description is an exemplification of the principles of the invention and is not intended to limit the invention to the particular embodiments illustrated.

All published documents, including all U.S. patent documents, mentioned anywhere in this application are hereby expressly incorporated herein by reference in their entirety. Any copending patent applications, mentioned anywhere in this application are also hereby expressly incorporated herein by reference in their entirety.

In one aspect, the present invention relates to percussion primer compositions that include at least one energetic, at least one nano-size non-coated fuel particle having natural surface oxides thereon, and at least one oxidizer.

Optionally, a buffer or mixture of buffers may be employed.

In some embodiments, a sensitizer for increasing the sensitivity of the primary explosive is added to the primer compositions.

The primer mixture according to one or more embodiments of the invention creates sufficient heat to allow for the use of moderately active metal oxides that are non-hygroscopic, non-toxic and non-corrosive. The primary energetic is suitably selected from energetics that are relatively insensitive to shock, friction and heat according to industry standards, making processing of these energetics more safe. Some of the relatively insensitive explosives that find utility herein for use as the primary explosive have been categorized generally as a secondary explosive due to their relative insensitivity.

Examples of suitable classes of energetics include, but are not limited to, nitrate esters, nitramines, nitroaromatics and mixtures thereof. The energetics suitable for use herein include both primary and secondary energetics in these classes.

Examples of suitable nitramines include, but are not limited to, CL-20, RDX, HMX and nitroguanidine.

RDX (royal demolition explosive), hexahydro-1,3,5-trinitro-1,3,5 triazine or 1,3,5-trinitro-1,3,5-triazacyclohexane, may also be referred to as cyclonite, hexagen, or cyclotrimethylenetrinitramine.

HMX (high melting explosive), octahydro-1,3,5,7-tetranitro-1,3,5,7-tetrazocine or 1,3,5,7-tetranitro-1,3,5,7 tetraazacyclooctane (HMX), may also be referred to as cyclotetramethylene-tetranitramine or octagen, among other names.

CL-20 is 2,4,6,8,10,12-hexanitrohexaazaisowurtzitane (HNIW) or 2,4,6,8,10,12-hexanitro-2,4,6,8,10,12-hexaazatetracyclo[5.5.0.0$^{5,9}$0$^{3,11}$]-dodecane.

Examples of suitable nitroaromatics include, but are not limited to, tetryl (2,4,6-trinitrophenyl-methylnitramine), TNT (2,4,6-trinitrotoluene), DDNP (diazodinitrophenol or 4,6-dinitrobenzene-2-diazo-1-oxide) and mixtures thereof.

Examples of suitable nitrate esters include, but are not limited to, PETN (pentaerythritoltetranitrate) and nitrocellulose.

The above lists are intended for illustrative purposes only, and not as a limitation on the scope of the present invention.

In some embodiments, nitrocellulose is employed. Nitrocellulose, particularly nitrocellulose having a high percentage of nitrogen, for example, greater than about 10 wt-% nitrogen, and having a high surface area, has been found to increase sensitivity. In primers wherein the composition includes nitrocellulose, flame temperatures exceeding those of lead styphnate have been created. In some embodiments, the nitrocellulose has a nitrogen content of about 12.5-13.6% by weight and a particle size of 80-120 mesh.

The primary explosive can be of varied particulate size. For example, particle size may range from approximately 0.1 micron to about 100 microns. Blending of more than one size and type can be effectively used to adjust formulation sensitivity.

The primary explosive is suitably employed in amounts of about 5% to about 40% by weight. This range may be varied depending on the primary explosive employed.

Examples of suitable nano-size non-coated fuel particles include, but are not limited to, aluminum, boron, molybdenum, silicon, titanium, tungsten, magnesium, melamine, zirconium, calcium silicide, and mixtures thereof.

The size of the fuel particle may vary from about 0.05 microns (50 nm) to about 0.120 microns (about 120 nm), and suitably about 70 nm to about 120 nm. Suitably, the fuel particle has an average size of greater than 0.05 microns (50 nm), more suitably greater than about 0.070 microns (70 nm) and even more suitably has an average particle size of about 0.1 micron or about 100 nanometers. Although the present invention is not limited to this specific size of fuel particle, keeping the average size fuel particle above about 0.05 microns or 50 nanometers, can significantly improve the safety of processing due to the naturally occurring surface oxides and thicker oxide layer that exist on larger fuel particles. Smaller fuel particles may exhibit higher impact (friction) and shock sensitivities.

Very small fuel particles, such as those between about 20 nm and 50 nm, can be unsafe to handle. In the presence of oxygen they are prone to autoignition and are thus typically kept solvent wet or coated such as with polytetrafluoroethylene or an organic acid such as oleic acid.

Suitably, the fuel particles according to one or more embodiments of the invention have a natural oxide coating. Surface oxides reduce the sensitivity of the fuel particle, and reduce the need to provide any additional protective coating such as a fluoropolymer coating, e.g. polytetrafluoroethylene (PTFE), an organic acid coating or a phosphate based coating to reduce sensitivity and facilitate safe processing of the composition. See, for example, U.S. Pat. No. 5,717,159 or U.S. Patent Application Publication No. US 200610113014 A1, both of which are incorporated by reference herein in their entirety.

The natural oxide coating on nano-size particles having a larger average particle size, i.e. those having a particle size of about 50 nm to about 120 nm, suitably those having a particle size of about 70 nm to about 120 nm, improves the stability of the particles, which consequently increases the margin of safety for processing and handling. Furthermore, a lower surface area may also decrease hazards while handling the nano-size fuel particles as risk of an electrostatic discharge initiation of the nano-size fuel particles decreases as the surface area decreases.

Thus, coatings for the protection of the fuel particle may be eliminated due to the increased surface oxides on the larger fuel particles.

A specific example of an aluminum fuel particle that may be employed herein is Alex® nano-aluminum powder having an average particle size of about 100 nanometers (0.1 microns) available from Argonide Nanomaterials in Pittsburgh, Pa.

Suitably, the nano-size fuel particles are employed in amounts of about 5% to about 20% by weight of the primer composition.

Buffers can be optionally added to the primer compositions to decrease the likelihood of hydrolysis of the fuel particles, which is dependent on both temperature and pH. While single acid buffers may be employed, the present inventors have found that a dual acid buffer system significantly increases the temperature stability of the percussion primer composition. Of course, more than two buffers may be employed as well. For example, it has been found that while a single acid buffer system can increase the temperature at which hydrolysis of the fuel particle occurs to about 120-140° F. (about 49° C.-60° C.), these temperatures are not sufficient for standard processing of percussion primers that includes oven drying. Therefore, higher hydrolysis onset temperatures are desirable for safe oven drying of the percussion primer compositions.

While any buffer may be suitably employed herein, it has been found that some buffers are more effective than others for reducing the temperature of onset of hydrolysis. For example, in some embodiments, an organic acid and a phosphate salt are employed. More specifically, in some embodiments, a combination of citrate and phosphate are employed. In weakly basic conditions, the dibasic phosphate ion ($HPO_4^{2-}$) and the tribasic citrate ion ($C_6H_5O_7^{3-}$) are prevalent. In weakly acid conditions, the monobasic phosphate ion ($H_2PO_4^-$) and the dibasic citrate ion ($C_6H_6O_7^{2-}$) are most prevalent.

Furthermore, the stability of explosives to both moisture and temperature is desirable for safe handling of firearms. For example, small cartridges are subject to ambient conditions including temperature fluctuations and moisture, and propellants contain small amounts of moisture and volatiles. It is desirable that these loaded rounds are stable for decades, be stable for decades over a wide range of environmental conditions of fluctuating moisture and temperatures.

It has been discovered that primer compositions according to one or more embodiments of the invention can be safely stored water wet (25%) for long periods without any measurable affect on the primer sensitivity or ignition capability. In some embodiments, the primer compositions may be safely stored for at least about 5 weeks without any measurable affect on primer sensitivity or ignition capability.

The aluminum contained in the percussion primer compositions according to one or more embodiments of the invention exhibit no exotherms during simulated bulk auto ignition tests (SBAT) at temperatures greater than about 200° F. (about 93° C.), and even greater than about 225° F. (about 107° C.) when tested as a slurry in water.

In some embodiments, additional fuels may be added.

A sensitizer may be added to the percussion primer compositions according to one or more embodiments of the invention. As the particle size of the nano-size fuel particles increases, sensitivity decreases. Thus, a sensitizer may be beneficial. Sensitizers may be employed in amounts of 0% to about 20%, suitably 0% to about 15% by weight and more suitably 0% to about 10% by weight of the composition. One example of a suitable sensitizer includes, but is not limited to, tetracene.

The sensitizer may be employed in combination with a friction generator. Friction generators are useful in amounts of about 0% to about 25% by weight of the primer composition. One example of a suitable friction generator includes, but is not limited to, glass powder.

Tetracene is suitably employed as a sensitizing explosive while glass powder is employed as a friction generator.

An oxidizer is suitably employed in the primer compositions according to one or more embodiments of the invention. Oxidizers may be employed in amounts of about 20% to about 70% by weight of the primer composition. Suitably, the oxidizers employed herein are moderately active metal oxides, and are non-hygroscopic and are not considered toxic. Examples of oxidizers include, but are not limited to, bismuth oxide, bismuth subnitrate, bismuth tetroxide, bismuth sulfide, zinc peroxide, tin oxide, manganese dioxide, molybdenum trioxide, and combinations thereof.

Other conventional primer additives such as binders may be employed in the primer compositions herein as is known in the art. Both natural and synthetic binders find utility herein. Examples of suitable binders include, but are not limited to, natural and synthetic gums including xanthan, Arabic, tragacanth, guar, karaya, and synthetic polymeric binders such as hydroxypropylcellulose and polypropylene oxide, as well as mixtures thereof. See also U.S. Patent Publication No. 2006/0219341 AI, the entire content of which is incorporated by reference herein. Binders may be added in amounts of about 0.1 wt % to about 5 wt-% of the composition, and more suitably about 0.1 wt % to about 1 wt % of the composition.

Other optional ingredients as are known in the art may also be employed in the compositions according to one or more embodiments of the invention. For example, inert fillers, diluents, other binders, low output explosives, etc., may be optionally added.

The above lists and ranges are intended for illustrative purposes only, and are not intended as a limitation on the scope of the present invention.

The primer compositions according to one or more embodiments of the invention may be processed using simple water processing techniques. The present invention allows the use of larger fuel particles which are safer for handling while maintaining the sensitivity of the assembled primer. It is surmised that this may be attributed to the use of larger fuel particles and/or the dual buffer system. The steps of milling and sieving employed for MIC-MNC formulations may also be eliminated. For at least these reasons, processing of the primer compositions according to the invention is safer.

The method of making the primer compositions according to one or more embodiments of the invention generally includes mixing the primary explosive water wet with at least one nano-size non-coated fuel particle having natural surface oxides thereon to form a first mixture, and adding an oxidizer to the first mixture. The oxidizer may be optionally dry blended with at least one binder to form a second dry mixture, and the second mixture then added to the first mixture and mixing until homogeneous to form a final mixture.

As used herein, the term water-wet, shall refer to a water content of between about 10 wt-% and about 40 wt-%, more suitably about 18% to about 30% and most suitably about 25% by weight.

If a sensitizer is added, the sensitizer may be added either to the water wet primary explosive, or to the primary explosive/nano-size non-coated fuel particle water wet blend. The sensitizer may optionally further include a friction generator such as glass powder.

At least one buffer, or combination of two or more buffers, may be added to the process to keep the system acidic and to prevent significant hydrogen evolution and further oxides from forming. In embodiments wherein the metal based fuel is subject to hydrolysis, such as with aluminum, the addition of a mildly acidic buffer having a pH in the range of about 4-8, suitably 4-7, can help to prevent such hydrolysis. While at a pH of 8, hydrolysis is delayed, by lowering the pH, hydrolysis can be effectively stopped, thus, a pH range of 4-7 is preferable. The buffer solution is suitably added as increased moisture to the primary explosive prior to addition of the non-coated nano-size fuel particle. Furthermore, the nano-size fuel particle may be pre immersed in the buffer solution to further increase handling safety.

Although several mechanisms can be employed depending on the primary explosive, it is clear that simple water mixing methods may be used to assemble the percussion primer using standard industry practices and such assembly can be accomplished safely without stability issues. The use of such water processing techniques is beneficial as previous primer compositions such as MIC/MNC primer compositions have limited stability in water.

The nano-size fuel particles and the explosive can be water-mixed according to one or more embodiments of the invention, maintaining conventional mix methods and associated safety practices.

Broadly, primary oxidizer-fuel formulations according to one or more embodiments of the invention, when blended with fuels, sensitizers and binders, can be substituted in applications where traditional lead styphnate and diazodinitrophenol (DDNP) primers and igniter formulations are employed. The heat output of the system is sufficient to utilize non-toxic metal oxidizers of higher activation energy typically employed but under utilized in lower flame temperature DDNP based formulations.

Additional benefits of the present invention include improved stability, increased ignition capability, improved ignition reliability, lower final mix cost, and increased safety due to the elimination of lead styphnate production and handling.

The present invention finds utility in any igniter or percussion primer application where lead styphnate is currently employed. For example, the percussion primer according to the present invention may be employed for small caliber and medium caliber cartridges, as well as industrial powerloads.

The following tables provide various compositions and concentration ranges for a variety of different cartridges. Such compositions and concentration ranges are for illustrative purposes only, and are not intended as a limitation on the scope of the present invention.

For purposes of the following tables, the nitrocellulose is 30-100 mesh and 12.5-13.6 wt-% nitrogen. The nano-aluminum is sold under the tradename of Alex® and has an average particles size of 0.1 microns. The additional aluminum fuel is 80-120 mesh.

TABLE 1

Illustrative percussion primer compositions for pistol/small rifle.

| Pistol/Small Rifle | Range wt-% | Preferred wt-% |
|---|---|---|
| Nitrocellulose | 10-30 | 20 |
| Nano-Aluminum | 8-12 | 10 |
| Bismuth trioxide | 50-70 | 64.5 |
| Tetracene | 0-6 | 5 |
| Binder | 0.3-0.8 | 0.4 |
| Buffer/stabilizer | 0.1-0.5 | 0.1 |

TABLE 2

Illustrative percussion primer compositions for large rifle.

| Large rifle | Range wt-% | Preferred wt-% |
|---|---|---|
| Nitrocellulose | 6-10 | 7.5 |
| Single-base ground propellant | 10-30 | 22.5 |
| Nano-Aluminum | 8-12 | 10 |
| Aluminum | 2-6 | 4 |
| Bismuth trioxide | 40-60 | 50 |
| Tetracene | 0-6 | 5 |
| Binder | 0.3-0.8 | 0.4 |
| Buffer/stabilizer | 0.1-0.5 | 0.1 |

TABLE 3

Illustrative percussion primer compositions for industrial/commercial power load rimfire.

| Power load rimfire | Range wt-% | Preferred wt-% |
|---|---|---|
| Nitrocellulose | 14-22 | 18 |
| Nano-Aluminum | 7-15 | 9.5 |
| Bismuth trioxide | 30-43 | 38 |
| DDNP | 12-18 | 14.5 |
| Tetracene | 0-7 | 5 |
| Binder | 1-2 | 1 |
| Glass | 12-18 | 14 |

TABLE 4

Illustrative percussion primer compositions for industrial commercial power load rimfire.

| Rimfire | Range wt-% | Preferred wt-% |
|---|---|---|
| Nitrocellulose | 14-25 | 19 |
| Nano-Aluminum | 7-15 | 10 |
| Bismuth trioxide | 40-70 | 55 |
| Tetracene | 0-10 | 5 |
| Binder | 1-2 | 1 |
| Glass | 0-20 | 10 |

TABLE 5

Illustrative percussion primer compositions for industrial/commercial rimfire.

| Rimfire | Range wt-% | Preferred wt-% |
|---|---|---|
| Nitrocellulose | 12-20 | 15 |
| Nano-Aluminum | 8-12 | 10 |
| Bismuth trioxide | 50-72 | 59 |
| Tetracene | 4-10 | 5 |
| Binder | 1-2 | 1 |
| Glass | 0-25 | 10 |

TABLE 6

Illustrative percussion primer compositions for industrial/commercial shotshell.

| Shotshell | Range wt-% | Preferred wt-% |
|---|---|---|
| Nitrocellulose | 14-22 | 18 |
| Single-base ground propellant | 8-16 | 9 |
| Aluminum | 6-10 | 8 |
| Aluminum | 2-5 | 3 |
| Bismuth trioxide | 45-65 | 46 |
| Tetracene | 4-10 | 5 |
| Binder | 1-2 | 1 |
| Glass | 0-25 | 10 |

In one embodiment, the percussion primer is used in a centerfire gun cartridge or in a rimfire gun cartridge. In small arms using the rimfire gun cartridge, a firing pin strikes a rim of a casing of the gun cartridge. In contrast, the firing pin of small arms using the centerfire gun cartridge strikes a metal cup in the center of the cartridge casing containing the percussion primer. Gun cartridges and cartridge casings are known in the art and, therefore, are not discussed in detail herein. The force or impact of the firing pin may produce a percussive event that is sufficient to detonate the percussion primer in the rimfire gun cartridge or in the centerfire gun cartridge, causing the secondary explosive composition to ignite.

Figure 1B:
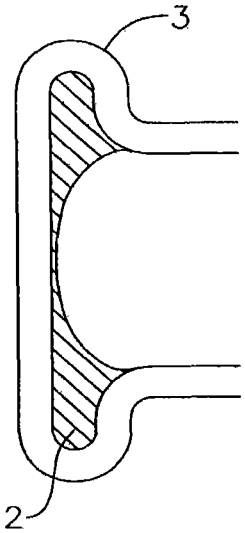
FIG. 1B is an enlarged view of the anterior portion of the rim fire gun cartridge shown in FIG. 1A.

Turning now to the figures, FIG. 1A is a longitudinal cross-section of a rimfire gun cartridge shown generally at 6. Cartridge 6 includes a housing 4. Percussion primer 2 may be substantially evenly distributed around an interior volume defined by a rim portion 3 of casing 4 of the cartridge 6 as shown in FIG. 1B which is an enlarged view of an anterior portion of the rimfire gun cartridge 6 shown in FIG. 1A.

Figure 2A:
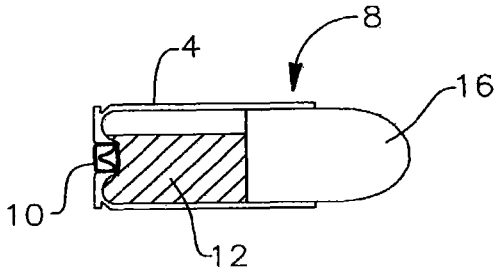
FIG. 2A a longitudinal cross-section of a centerfire gun cartridge employing a percussion primer composition of one embodiment of the invention.
Figure 2B:
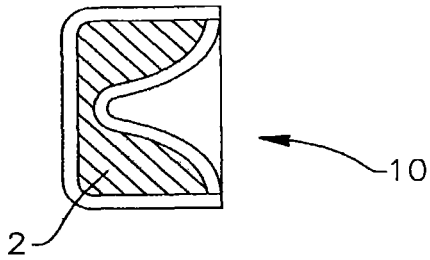
FIG. 2B is an enlarged view a portion of the centerfire gun cartridge of FIG. 2A that houses the percussion primer.

FIG. 2A is a longitudinal cross-sectional view of a centerfire gun cartridge shown generally at 8. In this embodiment, the percussion primer 2 may be positioned in an aperture 10 in the casing 4. FIG. 2B is an enlarged view of aperture 10 in FIG. 2A more clearly showing primer 2 in aperture 10.

The propellant composition 12 may be positioned substantially adjacent to the percussion primer 2 in the rimfire gun cartridge 6 or in the centerfire gun cartridge 8. When ignited or combusted, the percussion primer 2 may produce sufficient heat and condensing of hot particles to ignite the propellant composition 12 to propel projectile 16 from the barrel of the firearm or larger caliber ordnance (such as, without limitation, handgun, rifle, automatic rifle, machine gun, any small and medium caliber cartridge, automatic cannon, etc.) in which the cartridge 6 or 8 is disposed. The combustion products of the percussion primer 2 may be environmentally friendly, noncorrosive, and nonabrasive.

Figure 3:
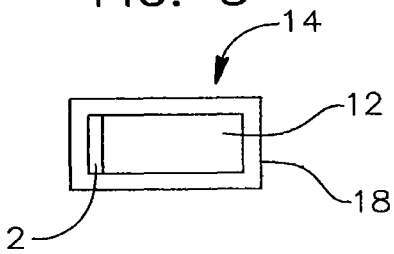
FIG. 3 is a schematic illustration of exemplary ordnance in which a percussion primer of one embodiment of the invention is used.

As previously mentioned, the percussion primer 2 may also be used in larger ordnance, such as (without limitation) grenades, mortars, or detcord initiators, or to initiate mortar rounds, rocket motors, or other systems including a secondary explosive, alone or in combination with a propellant, all of the foregoing assemblies being encompassed by the term "primer-containing ordnance assembly," for the sake of convenience. In the ordnance, motor or system 14, the percussion primer 2 may be positioned substantially adjacent to a secondary explosive composition 12 in a housing 18, as shown in FIG. 3.

The following non-limiting examples further illustrate the present invention but are in no way intended to limit the scope thereof.

EXAMPLES

Example 1

| | | |
|---|---|---|
| Nitrocellulose | 10-40 wt % | |
| Aluminum | 5-20 wt % | (average particle size 0.1 micron) |
| Aluminum | 0-15 wt % | (standard mesh aluminum as common to primer mixes) |
| Tetracene | 0-10 wt % | |
| Bismuth Trioxide | 20-75 wt % | |
| Gum Tragacanth | 0.1-1.0 wt % | |

The nitrocellulose in an amount of 30 grams was placed water-wet in a mixing apparatus. Water-wet tetracene, 5 g, was added to the mixture and further mixed until the tetracene was not visible. Nano-aluminum powder, 109, was added to the water-wet nitrocellulose/tetracene blend and mixed until homogeneous. Bismuth trioxide, 54 g, was dry blended with 1 g of gum tragacanth and the resultant dry blend was added to the wet explosive mixture, and the resultant blend was then mixed until homogeneous. The final mixture was removed and stored cool in conductive containers.

Example 2

Various buffer systems were tested using the simulated bulk autoignition temperature (SBA T) test. Simple acidic buffers provided some protection of nano-aluminum particles. However, specific dual buffer systems exhibited significantly higher temperatures for the onset of hydrolysis. The sodium hydrogen phosphate and citric acid dual buffer system exhibited significantly higher temperatures before hydrolysis occurred. This is well above stability requirements for current primer mix and propellants. As seen in the SBAT charts, even at pH=8.0, onset with this system is delayed to 222° F. (105.6° C.) (see no. 10 above). At a pH of 5.0, hydrolysis is effectively stopped.

| Buffer | pH | SBAT onset Temperature ° F. (° C.) |
|---|---|---|
| 1) Distilled water only | | 118° F. (47.8° C.) |
| 2) Sodium acetate/acetic acid | 5.0 | 139° F. (59.4° C.) |
| 3) Potassium phosphate/borax | 6.6 | 137° F. (58.3° C.) |
| 4) Potassium phosphate/borax | 8.0 | 150° F. (65.6° C.) |
| 5) Sodium hydroxide/acetic acid/phosphoric acid/boric acid | 5.02 | 131° F. (55° C.) |
| 6) Sodium hydroxide/acetic acid/phosphoric acid/boric acid | 6.6 | 125° F. (51.7° C.) |
| 7) Sodium hydroxide/acetic acid/phosphoric acid/boric acid | 7.96 | 121° F. (49.4° C.) |
| 8) Sodium hydrogen phosphate/citric acid | 5.0 | No exotherm/water evaporation endotherm only |
| 9) Sodium hydrogen phosphate/citric acid | 6.6 | 239° F. (115° C.) |
| 10) Sodium hydrogen phosphate/citric acid | 8.0 | 222° F. (105.6° C.) |
| 11) Citric acid/NaOH (3.84 g/1.20 g in 100 g $H_2O$) | 4.29 | 140° F. (60° C.) |
| 12) Citric acid/NaOH (3.84 g/2.00 g in 100 g $H_2O$) | 5.43 | 100° F. (37.8° C.) |
| 13) Sodium hydrogen phosphate (2.40 g/2.84 g in 100 g $H_2O$) | 6.57 | 129° F. (53.9° C.) |

As can be seen from Table 7, the combination of sodium hydrogen phosphate and citric acid significantly increases the temperature of onset of hydrolysis at a pH of 8.0 to 222° F. (105.6° C.) (see no. 10 above). At a pH of 5.0, hydrolysis is effectively stopped.

Figure 4:
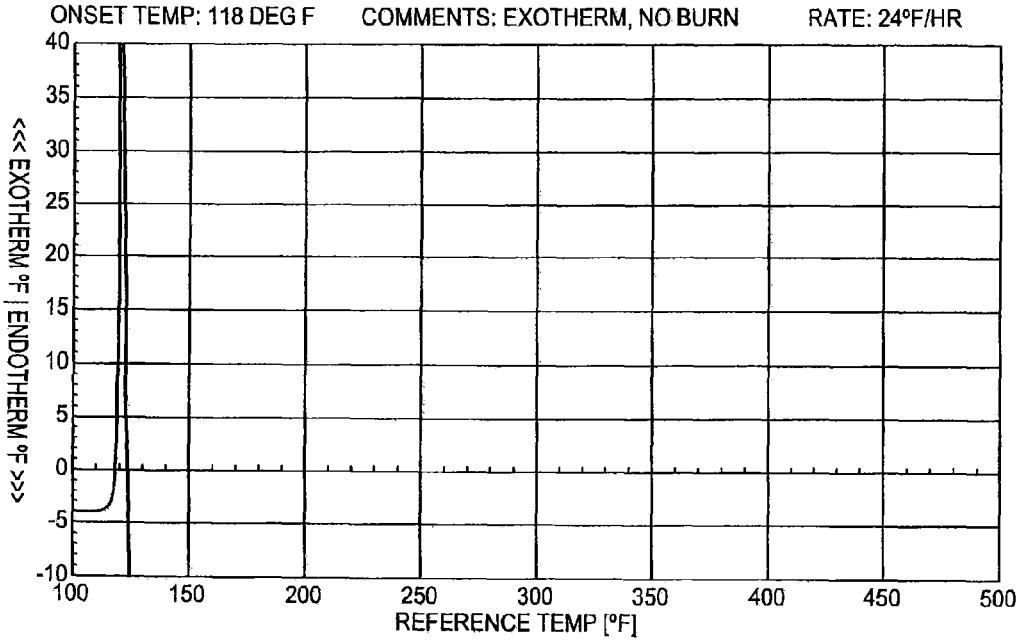
FIG. 4 is a simulated bulk autoignition temperature (SBA T) graph.

FIG. 4 is an SBAT graph illustrating the temperature at which hydrolysis begins when Alex® aluminum particles are mixed in water with no buffer. The hydrolysis onset temperature is 118° F. (47.8° C.). See no. 1 in table 7.

Figure 5:
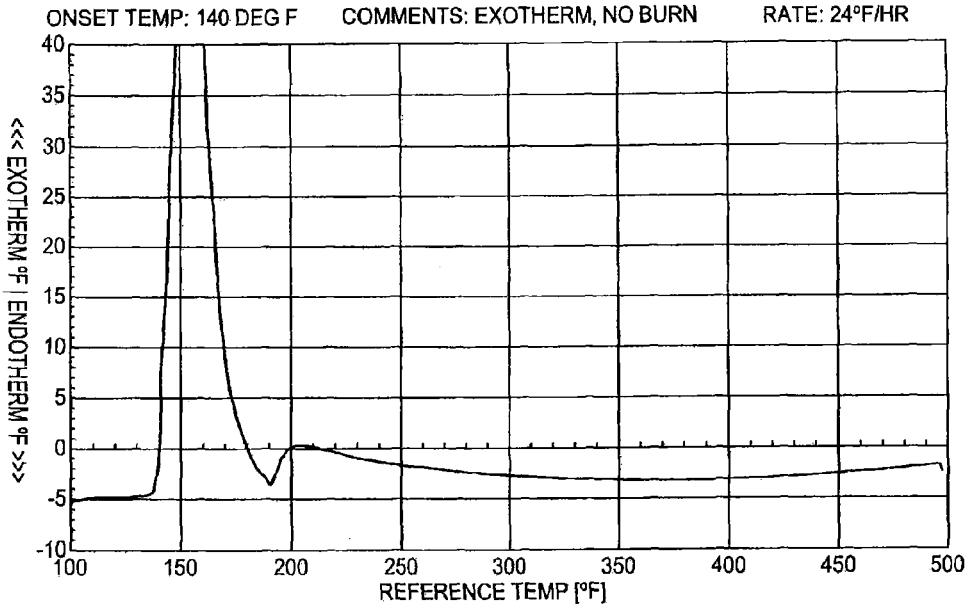
FIG. 5 is an SBAT graph.

FIG. 5 is an SBAT graph illustrating the temperature at which hydrolysis begins using only a single buffer which is citrate. The hydrolysis onset temperature is 140° F. (60° C.). See no. 11 in table 7.

Figure 6:
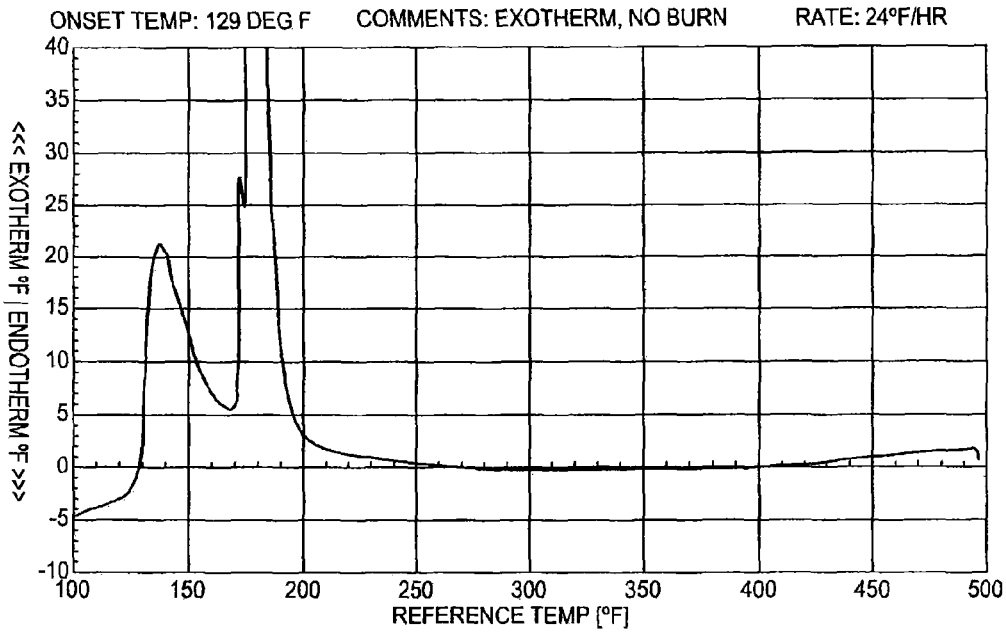
FIG. 6 is an SBAT graph.

FIG. 6 is an SBAT graph illustrating the temperature at which hydrolysis begins using only a single buffer which is a phosphate buffer. The hydrolysis onset temperature is 129° F. (53.9° C.).

Figure 7:
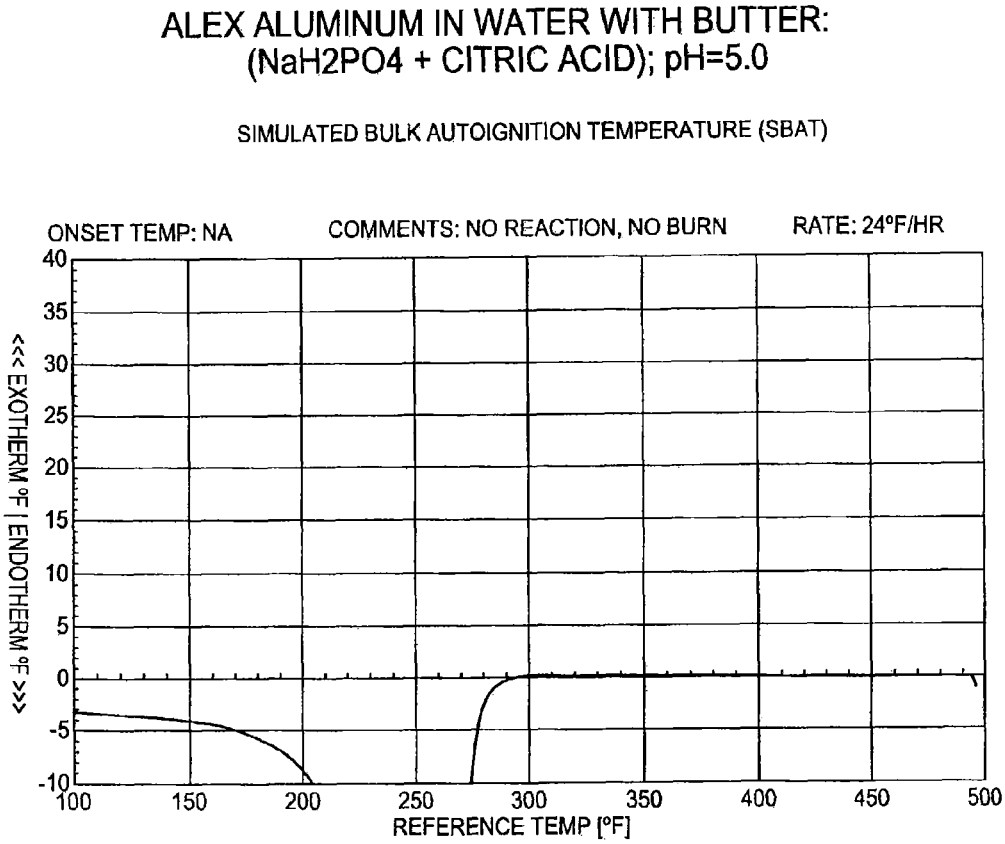
FIG. 7 is an SBAT graph.

FIG. 7 is an SBAT graph illustrating the temperature at which hydrolysis begins using a dual citrate/phosphate buffer system. Hydrolysis has been effectively stopped at a pH of 5.0 even at temperatures of well over 200° F. (about 93° C.).

As previously discussed, the present invention finds utility in any application where lead styphnate based igniters or percussion primers are employed. Such applications typically include an igniter or percussion primer, a secondary explosive, and for some applications, a propellant.

As previously mentioned, other applications include, but are not limited to, igniters for grenades, mortars, detcord initiators, mortar rounds, detonators such as for rocket motors and mortar rounds, or other systems that include a primer or igniter, a secondary explosive system, alone or in combination with a propellant, or gas generating system such as air bag deployment and jet seat ejectors.

The above disclosure is intended to be illustrative and not exhaustive. This description will suggest many variations and alternatives to one of ordinary skill in this art. All these alternatives and variations are intended to be included within the scope of the attached claims. Those familiar with the art may recognize other equivalents to the specific embodiments described herein which equivalents are also intended to be encompassed by the claims attached hereto.

The invention claimed is:

1. A primer composition comprising:

an explosive consisting essentially of at least one moderately insensitive explosive in an amount of about 5 wt-% to about 40 wt-% of the primer composition and optionally a sensitizer, the at least one moderately insensitive explosive chosen from nitrocellulose, pentaerythritol tetranitrate ("PETN"), 2,4,6,8,10,12-hexanitro-2,4,6,8,10,12-hexaazatetracyclo [5.5.0.0.$^{5,9}$0$^{3,11}$]-dodecane ("CL-20"), cyclo-1,3,5-trimethylene-2,4,6-trinitramine ("RDX"), cyclotetramethylene tetranitramine ("HMX"), 2,4,6-trinitrotoluene ("TNT"), nitroguanidine, styphnic acid, potassium dinitrobenzofuroxan ("KDNBF"), and mixtures thereof;

a plurality of nano-size fuel particles having an average particle size of about 50 nm to about 120 nm; and an oxidizer;

wherein the primer composition is essentially devoid of other explosives except for the optional sensitizer and/or a propellant.

2. The primer composition of claim 1, further comprising a sensitizer in an amount of greater than 0 wt-% to about 20 wt-% of the primer composition.

3. The primer composition of claim 2, wherein the sensitizer is tetracene.

4. The primer composition of claim 1, wherein the plurality of nano-size fuel particles are chosen from aluminum, boron, molybdenum, silicon, titanium, tungsten, magnesium, melamine, zirconium, calcium silicide, and mixtures thereof.

5. The primer composition of claim 4, wherein the plurality of nano-size fuel particles are present in an amount of about 5 wt-% to about 20 wt-% of the primer composition.

6. The primer composition of claim 5, wherein the plurality of nano-size fuel particles comprise aluminum.

7. The primer composition of claim 5, wherein said plurality of nano-size fuel particles have an average particle size of about 80 nm to about 120 nm.

8. The primer composition of claim 1, wherein the oxidizer is chosen from bismuth trioxide, bismuth subnitrate, bismuth tetroxide, bismuth sulfide, zinc peroxide, tin oxide, manganese dioxide, molybdenum trioxide, potassium nitrate, and combinations thereof.

9. The primer composition of claim 8, wherein the oxidizer is present in an amount of about 20 wt-% to about 70 wt-% of the primer composition.

10. The primer composition of claim 1, further comprising at least one buffer.

11. The primer composition of claim 1, the at least one buffer chosen from at least one inorganic acid or salt thereof, at least one organic acid or salt thereof, and combinations thereof.

12. The primer composition of claim 1, further comprising a friction generator.

13. The primer composition of claim 12, wherein the friction generator comprises glass powder.

14. The primer composition of claim 1, further comprising a binder.

15. The primer composition of claim 1, further comprising a single-base ground propellant.

16. A primer composition comprising:

a composite primary explosive consisting essentially of at least one moderately insensitive explosive, a plurality of nano-size fuel particles, and optionally a sensitizer; the at least one moderately insensitive explosive chosen from nitrocellulose, pentaerythritol tetranitrate ("PEN"), 2,4,6,8,10,12-hexanitro-2,4,6,8,10,12-hexaazatetracyclo[5.5.0.0.$^{5,9}$0$^{3,11}$]-dodecane ("CL-20"), cyclo-1,3,5-trimethylene-2,4,6-trinitramine ("RDX"), cyclotetramethylene tetranitramine ("HMX"), 2,4,6-trinitrotoluene ("TNT"), nitroguanidine, styphnic acid, potassium dinitrobenzofuroxan ("KDNBF"), and mixtures thereof, and the plurality of nano-size fuel particles having an average particle size of about 50 nm to about 120 nm; and an oxidizer;

wherein the primer composition is essentially devoid of other explosives except for the optional sensitizer and/or a propellant.

17. The primer composition of claim 16, further comprising a sensitizer in an amount of greater than 0 wt-% to about 20 wt-% of the primer composition.

18. The primer composition of claim 17, wherein the sensitizer is tetracene.

19. The primer composition of claim 18, wherein the at least one moderately insensitive explosive is present in an amount of less than about 40 wt-% of the primer composition.

20. The primer composition of claim 19, wherein the plurality of nano-size fuel particles are present in an amount of about 5 wt-% to about 20 wt-% of the primer composition and chosen from aluminum, boron, molybdenum, silicon, titanium, tungsten, magnesium, melamine, zirconium, calcium silicide, and mixtures thereof.

21. The primer composition of claim 20, wherein the plurality of nano-size fuel particles comprise aluminum.

22. The primer composition of claim 20, further comprising aluminum fuel having a size between 80 and 120 mesh.

23. The primer composition of claim 20, wherein said plurality of nano-size fuel particles have an average particle size of about 80 nm to about 120 nm.

24. The primer composition of claim 23, wherein the oxidizer is present in an amount of about 20 wt-% to about 70 wt-% of the primer composition and is chosen from bismuth trioxide, bismuth subnitrate, bismuth tetroxide, bismuth sulfide, zinc peroxide, tin oxide, manganese dioxide, molybdenum trioxide, potassium nitrate, and combinations thereof.

25. The primer composition of claim 24, further comprising at least one buffer chosen from a at least one inorganic acid or salt thereof, at least one organic acid or salt thereof, and combinations thereof.

26. The primer composition of claim 25, further comprising a friction generator.

27. The primer composition of claim 25, further comprising a single-base ground propellant.

28. A primer composition comprising:

an explosive consisting essentially of at least one moderately insensitive explosive in an amount of about 5 wt-% to about 40 wt-% of the primer composition and optionally a sensitizer in an amount of about 0 wt-% to about 20 wt-% of the primer composition, the at least one moderately insensitive explosive chosen from nitrocellulose, pentaerythritol tetranitrate ("PETN"), 2,4,6,8,10,12-hexanitro-2,4,6,8,10,12-hexaazatetracyclo[5.5.0.0.$^{5,9}$0$^{3,11}$]-dodecane ("CL-20"), cyclo-1,3,5-trimethylene-2,4,6-trinitramine ("RDX"), cyclotetramethylene tetranitramine ("HMX"), 2,4,6-trinitrotoluene ("TNT"), nitroguanidine, styphnic acid, potassium dinitrobenzofuroxan ("KDNBF"), and mixtures thereof;

a plurality of nano-size fuel particles having an average particle size of about 50 nm to about 120 nm in an amount of about 5 wt-% to about 20 wt-% of the primer composition; and an oxidizer in an amount of about 20 wt-% to about 70 wt-% of the primer composition;

wherein the primer composition is essentially devoid of other explosives except for the optional sensitizer and/or a propellant.

29. The primer composition of claim 28, further comprising a sensitizer, the sensitizer comprising tetracene in an amount greater than 0 wt-% and less than about 20 wt-% of the primer composition.

30. The primer composition of claim 28, wherein the plurality of nano-size fuel particles having an average particles size of about 80 nm to about 120 nm and chosen from aluminum, boron, molybdenum, silicon, titanium, tungsten, magnesium, melamine, zirconium, calcium silicide, and mixtures thereof.

31. The primer composition of claim 30, wherein the oxidizer is chosen from bismuth trioxide, bismuth subnitrate, bismuth tetroxide, bismuth sulfide, zinc peroxide, tin oxide, manganese dioxide, molybdenum trioxide, potassium nitrate, and combinations thereof.

32. The primer composition of claim 31, further comprising aluminum fuel having a size between 80 and 120 mesh.

33. The primer composition of claim 31, further comprising at least one buffer chosen from at least one inorganic acid or salt thereof, at least one organic acid or salt thereof, and combinations thereof.

34. The primer composition of claim 31, further comprising a friction generator.

35. The primer composition of claim 31, further comprising a single-base ground propellant.

* * * * *